US012808146B2

(12) United States Patent
Krone et al.

(10) Patent No.: US 12,808,146 B2
(45) Date of Patent: Nov. 24, 2026

(54) SURFACE-ENGAGING IMPLEMENT POSITION CONTROL FOR ROLLOVER PROTECTION

(71) Applicant: Caterpillar Inc., Peoria, IL (US)

(72) Inventors: Bradley P. Krone, Dunlap, IL (US); Christopher M. Gerth, Chillicothe, IL (US); Jared J. Harris, Sahuarita, AZ (US)

(73) Assignee: Caterpillar Inc., Peoria, IL (US)

( * ) Notice: Subject to any disclaimer, the term of this patent is extended or adjusted under 35 U.S.C. 154(b) by 355 days.

(21) Appl. No.: 18/545,653

(22) Filed: Dec. 19, 2023

(65) Prior Publication Data

US 2025/0198116 A1 Jun. 19, 2025

(51) Int. Cl.

| | |
|---|---|
| ***E02F 3/84*** | (2006.01) |
| ***E02F 9/24*** | (2006.01) |
| ***E02F 9/26*** | (2006.01) |

(52) U.S. Cl.

CPC ..... *E02F 3/844* (2013.01); *E02F 9/24* (2013.01); *E02F 9/26* (2013.01)

(58) Field of Classification Search

CPC ..... E02F 3/844; E02F 9/24; E02F 9/26; E02F 5/32; E02F 9/2033; E02F 9/262; E02F 9/265

See application file for complete search history.

(56) References Cited

U.S. PATENT DOCUMENTS

| | | | |
|---|---|---|---|
| 4,031,964 | A | 6/1977 | Takahashi et al. |
| 4,062,539 | A | 12/1977 | Tetsuka et al. |
| 5,293,944 | A | 3/1994 | Matsumoto |
| 5,685,377 | A | 11/1997 | Artstein et al. |
| 6,278,955 | B1 | 8/2001 | Hartman et al. |

(Continued)

FOREIGN PATENT DOCUMENTS

| | | | |
|---|---|---|---|
| CN | 105002943 | A | 10/2015 |
| CN | 109797793 | B | 7/2021 |

(Continued)

OTHER PUBLICATIONS

U.S. Appl. No. 18/539,772, filed Dec. 14, 2023.

(Continued)

*Primary Examiner* — Ryan Rink

(57) ABSTRACT

A mobile machine for operation on a work surface includes: a frame; a traction device mounted to the frame for moving the mobile machine with respect to the work surface; a surface-engaging implement mounted to the frame, the surface-engaging implement having an implement position movable between an operational position, in which the surface-engaging implement at least partially contacts the work surface, and a stowed position, in which the surface-engaging implement does not contact the work surface; at least one actuator connecting the surface-engaging implement to the frame for moving the surface-engaging implement between the operational position and the stowed position; a first sensor for providing the implement position of the surface-engaging implement; a second sensor for providing a machine orientation of the mobile machine with respect to a horizon; and a controller for receiving the implement position and the machine orientation.

20 Claims, 7 Drawing Sheets

(56) References Cited

U.S. PATENT DOCUMENTS

| | | | | |
|---|---|---|---|---|
| 6,317,676 | B1 | 11/2001 | Gengler et al. | |
| 8,019,514 | B2 * | 9/2011 | Yuet | B60T 7/12 701/1 |
| 8,083,004 | B2 | 12/2011 | Knight, Jr. | |
| 8,616,297 | B2 | 12/2013 | Shintani et al. | |
| 8,788,157 | B2 | 7/2014 | Shintani et al. | |
| 9,033,062 | B2 | 5/2015 | Stratton et al. | |
| 9,292,813 | B2 | 3/2016 | Tucker et al. | |
| 9,435,102 | B2 | 9/2016 | Hall | |
| 9,624,650 | B2 | 4/2017 | Stratton | |
| 10,246,087 | B2 | 4/2019 | Mitchell et al. | |
| 10,518,637 | B2 | 12/2019 | Uemura et al. | |
| 11,215,781 | B1 | 1/2022 | Pino, Jr. | |
| 2008/0208416 | A1 * | 8/2008 | Yuet | B60W 30/04 340/440 |
| 2011/0022267 | A1 * | 1/2011 | Murphy | B60W 50/14 701/124 |
| 2012/0073843 | A1 | 3/2012 | Kure | |
| 2012/0318541 | A1 | 12/2012 | Sulzer | |
| 2015/0176253 | A1 * | 6/2015 | Taylor | E02F 9/265 701/33.9 |
| 2017/0030052 | A1 | 2/2017 | Wei et al. | |
| 2017/0204588 | A1 | 7/2017 | Faivre et al. | |
| 2020/0062241 | A1 * | 2/2020 | Kelber | B60W 30/04 |
| 2020/0172087 | A1 * | 6/2020 | Shur | E02F 9/2025 |
| 2022/0316173 | A1 | 10/2022 | Narikawa et al. | |
| 2023/0249674 | A1 * | 8/2023 | Omohundro | B60G 17/0195 |

FOREIGN PATENT DOCUMENTS

| | | | |
|---|---|---|---|
| CN | 107313475 | B | 2/2023 |
| JP | 2013-217057 | A | 10/2013 |
| KR | 20150061822 | A | 6/2015 |
| KR | 102252607 | B1 | 5/2021 |
| WO | WO 2022/239296 | A1 | 11/2022 |

OTHER PUBLICATIONS

U.S. Appl. No. 18/392,915, filed Dec. 21, 2023.
U.S. Appl. No. 18/394,268, filed Dec. 22, 2023.
U.S. Appl. No. 18/394,295, filed Dec. 22, 2023.

* cited by examiner

SURFACE-ENGAGING IMPLEMENT POSITION CONTROL FOR ROLLOVER PROTECTION

FIELD

The present disclosure generally relates to systems, methods, and controllers to assist a mobile machine, such as a bulldozer, in reducing its risk of rollover as a result of the mobile machine operating a surface-engaging implement, such as a ripper, or the mobile machine traversing a work surface that causes the mobile machine to have an orientation more likely to induce rollover.

BACKGROUND

Mobile machines, such as, for example, bulldozers, agricultural tractors, and scrapers, often include one or more surface-engaging implements for cultivating, digging, ripping, or otherwise disturbing a work surface, such as a ripper.

FIGS. 1-2 are a schematic views of an exemplary mobile machine 10. Mobile machine 10 may include any mobile machine that performs some type of operation associated with an industry, such as, for example, mining, construction, farming, or any other industry known in the art. For example, mobile machine 10 may be an earth-moving mobile machine such as a bulldozer, a loader, a backhoe, an excavator, a motor grader, or any other earth-moving machine. Mobile machine 10 may traverse a work site to manipulate material beneath a work surface 12, e.g., transport, cultivate, dig, rip, and/or perform any other operation known in the art. Mobile machine 10 may include a power source 14 configured to produce mechanical power, a traction device 16, at least one surface-engaging implement, such as ripper 18, and an operator station 20 to house operator controls. Mobile machine 10 includes a frame 22 for supporting one or more components of mobile machine 10 (e.g., power source 14, traction device 16, ripper 18, etc.).

Power source 14 may be any type of internal combustion engine such as, for example, a diesel engine, a gasoline engine, or a gaseous fuel-powered engine. Power source 14 may instead be a non-engine type of power producing device such as, for example, a fuel cell, a battery, a motor, or another type of power source known in the art. Power source 14 may produce a variable power output directed to ripper 18 and traction device 16 in response to one or more inputs.

Traction device 16 may include tracks located on each side of mobile machine 10 (of which only one side shown in FIGS. 1-2) and operatively driven by one or more sprockets 24. Sprockets 24 may be operatively connected to power source 14 to receive power therefrom and drive traction device 16. Movement of traction device 16 may propel mobile machine 10 with respect to work surface 12. It is contemplated that traction device 16 may additionally or alternately include wheels, belts, or other traction devices, which may or may not be steerable. It is also contemplated that traction device 16 may be hydraulically actuated, mechanically actuated, electronically actuated, or actuated in any other suitable manner.

The surface-engaging implement, such as ripper 18, can be mounted directly on frame 22 or mounted on a frame arm 23, which in turn is connected to frame 22. In either case, however, ripper 18 is rotatable (i.e., about frame 22 or frame arm 23). Ripper 18 may be configured to lift, lower, and tilt relative to frame 22. For example, ripper 18 may include a work tool, such as a shank 26, held in place by a mounting member 27. Shank 26 may penetrate work surface 12 to disturb or disrupt (i.e., rip) the material below work surface 12, and may move relative to mounting member 27. More specifically, shank 26 may have several configurations relative to mounting member 27. For example, shank 26 may be moved higher, lower, away from, and toward frame 22. Mounting member 27 may be connected to frame 22 via a linkage system with at least one implement actuator forming a member in the linkage system, and/or in any other suitable manner. For example, a first hydraulic actuator 28 may be connected to lift and lower ripper 18, and a second hydraulic actuator 30 may be connected to tilt ripper 18. It is contemplated that surface-engaging implement 18 may alternatively include a plow, a tine, a cultivator, and/or any other task-performing work tool known in the art, rather than shank 26.

The movement of ripper 18 may correspond to a plurality of predetermined locations and/or orientations. For example, ripper 18 may have a work tool angle $\alpha$ and a frame arm angle $\beta$, as shown in FIGS. 1-2, that can be varied based on a material composition of work surface 12, a size or capacity of mobile machine 10, the configuration of shank 26 relative to mounting member 27, and/or one or more inputs of an operator. In one example, work tool angle $\alpha$ of shank 26 may correspond to shank 26 being substantially vertical relative to work surface 12 for efficient penetration of work surface 12 (for example, work tool angle $\alpha$ could be approximately 30°, as shown in FIG. 1, to have shank 26 be vertical with respect to work surface 12). In order to maintain such a work tool angle $\alpha$ for each of the available shank configurations, the implement actuators of mounting member 27 may need to be adjusted based on the current shank configuration. Frame arm angle $\beta$ of frame arm 23 may correspond to a forward tilt of shank 26 to facilitate efficient digging, while keeping shank 26 from digging under mobile machine 10 and forcing material against an underbelly of mobile machine 10. In order to maintain shank 26 at the correct digging position relative to the underbelly of mobile machine 10, the implement actuators of mounting member 27 may need to be adjusted based on the current shank configuration.

In an exemplary digging operation, an operator of mobile machine 10 may set the configuration of shank 26. For example, the operator may manually loosen bolts fastening shank 26 to mounting member 27 in a first configuration, move shank 26 to a discrete location on mounting member 27, and tighten the bolts to retain shank 26 in place. In another example, shank 26 may be movable by a motor, pulley system, or a hydraulic actuator to mechanically slide from the first configuration to the second configuration. It is contemplated that this sliding mechanism may be controlled electrically or mechanically by the operator and/or a controller. That is, the operator may set the configuration of shank 26 by manipulating a switch, a joystick, a button, or any other interface known in the art.

The operator may then control the implement actuators of mounting member 27 to set shank 26 to a dig angle $\theta$ associated with the current configuration of shank 26 with respect to work surface 12. That is, the operator may control the implement actuators of mounting member 27 to orient shank 26 relative to work surface 12 prior to penetration. The operator may then control the implement actuators to lower shank 26 and penetrate work surface 12. Once shank 26 has penetrated work surface 12, the operator may control the implement actuators of mounting member 27 to vary dig angle $\theta$ for the current configuration of shank 26. That is, the operator may control the implement actuators to set shank 26 to a dig angle θ, work tool angle α, and/or frame arm angle β that does not place shank 26 under mobile machine 10, yet facilitates efficient digging. It is contemplated that all or some of the above-described digging process may be managed automatically.

Hydraulic actuators 28, 30 may each include a piston-cylinder arrangement, a hydraulic motor, and/or another known hydraulic device having one or more fluid chambers therein. In a piston-cylinder arrangement, pressurized fluid may be selectively supplied to and drained from one or more chambers thereof to affect linear movement of the actuator, as is known in the art. In a hydraulic motor arrangement, pressurized fluid may be selectively supplied to and drained from chambers on either side of an impeller to affect rotary motion of hydraulic actuators 28, 30. The movement of hydraulic actuator 28 may assist in moving ripper 18 with respect to frame 22 and work surface 12, particularly down toward and up away from work surface 12. It is contemplated that an extension of hydraulic actuator 28 may correlate to a position of ripper 18 with respect to work surface 12. Similarly, the movement of hydraulic actuator 30 may assist in orienting ripper 18 with respect to frame 22 and work surface 12, particularly decreasing or increasing dig angle θ and/or work tool angle α. It is contemplated that an extension of hydraulic actuator 30 may correlate to an orientation of ripper 18 with respect to work surface 12.

Operator station 20 may provide a control interface for an operator of mobile machine 10. For example, operator station 20 may include a deceleration pedal 32 and a ripper control 34. Although not shown, it is contemplated that operator station 20 may additionally include other controls such as, for example, a machine direction control, an acceleration pedal, or any other control device known in the art.

Ripper control 34 may allow an operator of mobile machine 10 to manipulate ripper 18. More specifically, ripper control 34 may control an amount or a pressure of fluid supplied to and drained from hydraulic actuators 28, 30. Thus, ripper control 34 may allow the operator to set a work tool height H of shank 26, as shown in FIG. 2, above or below work surface 12. For example, work tool height H could be positive if shank 26 is positioned above work surface 12, negative if shank 26 is positioned below work surface 12, or zero if positioned on work surface 12. Ripper control 34 also allows the operator to set work tool angle α, frame arm angle β, and dig angle θ. Ripper control 34 may allow the operator to move shank 26 from a position above work surface 12 down to penetrate work surface 12, and to set a depth of cut below work surface 12 (i.e., a negative work tool height H) so that shank 26 may disturb or disrupt the material below work surface 12 during a ripping operation. Ripper control 34 may also allow the operator to change work tool angle α, frame arm angle β, and dig angle θ while shank 26 is above or below work surface 12. For example, the operator may manipulate ripper control 34 to set shank 26 to a dig angle θ before lowering shank 26 to penetrate work surface 12. The operator may further manipulate ripper control 34 to set shank 26 to an optimal dig angle θ once shank 26 has penetrated work surface 12 to a desired depth (i.e., work tool height H). Ripper control 34 may embody, for example, a joystick. It is contemplated that ripper control 34 may embody any other appropriate control apparatus known in the art, and that ripper control 34 may alternatively embody separate control apparatuses for determining work tool angle α, frame arm angle β, dig angle θ, and work tool height H, respectively.

FIG. 3 illustrates control system 38 having components that cooperate to move ripper 18. For example, control system 38 may include a user interface 39, a first sensor 40 to measure machine speed, a second sensor 42 to measure a machine location of mobile machine 10, a third sensor 44 to monitor the positions of hydraulic actuators 28, 30, and a controller 46. User interface 39 may allow an operator to input values relevant to operation of mobile machine 10, such as, for example, an operation of shank 26 and a desired dig angle θ of shank 26. It is contemplated that optimal work tool angle α, frame arm angle β, dig angle θ, and work tool height H values may be predetermined or calculated automatically by controller 46 based on, for example, the configuration of shank 26 relative to mounting member 27.

Sensors 40, 42, 44 may each include conventional hardware to establish a signal as a function of a sensed physical parameter. Sensor 40 may be located to sense the machine speed of mobile machine 10 with respect to work surface 12. For example, sensor 40 may be disposed adjacent work surface 12, and may generate a signal indicative of the machine speed of mobile machine 10 relative to work surface 12. Sensor 40 may embody any type of motion or speed-sensing sensor, such as, for example, a global positioning sensor, an infrared sensor, a Hall sensor, a rotation sensor, or a radar sensor. For example, sensor 40 may be sensitive to variations in a given magnetic field generated by sensor 40 or by another component near sensor 40. As sprockets 24 rotate to drive traction device 16, magnetic elements embedded within sprockets 24 may cause a variation in a magnetic field. Sensor 40 may then use the frequency of the variations to calculate a speed of the driven component. Sensor 40 could instead be coupled to a transmission of mobile machine 10 to calculate mobile machine 10's machine speed from, if so equipped, an engine RPM and transmission gear ratio of power source 14 or traction device 16. Alternatively, sensor 40 may transmit a radio signal with a given wavelength and frequency toward work surface 12. The radio signal may bounce off of work surface 12 back to sensor 40 with a changed wavelength and/or frequency according to the Doppler effect. Sensor 40 may then use the difference between the original wavelength and frequency and the changed wavelength and frequency to calculate the speed of mobile machine 10. It is contemplated that sensor 40 may include a plurality of sensors establishing a plurality of signals, and that the plurality of signals may be combinable into a common signal, if desired.

Sensor 42 may sense a machine location of mobile machine 10 either globally and/or with respect to work surface 12. Sensor 42 may embody any type of location-sensing sensor, such as, for example, a satellite positioning unit of a global navigation satellite system, or GNSS. A GNSS is a satellite navigation system with global coverage that can be used to provide geo-positioning of objects associated with the GNSS, such as mobile machine 10. One example of a GNSS is a global positioning system, or GPS. Sensor 42 may be embodied as a satellite positioning unit disposed on mobile machine 10. The satellite positioning unit generates signals indicative of a machine location of mobile machine 10. The satellite positioning unit may determine and generate signals corresponding to the latitude and/or longitude of mobile machine 10. The satellite positioning unit may be disposed on a top portion of mobile machine 10 to communicate with a number of satellites of the GNSS and to receive signals indicative of a machine location of mobile machine 10. It is contemplated that sensor 42 may include a plurality of sensors establishing a plurality of signals, and that the plurality of signals may be combinable into a common signal, if desired.

Sensor 44 may sense an extension of one or more chambers of hydraulic actuators 28, 30. As indicated in FIG. 3, sensor 44 may embody, for example, two individual sensors 44*a*, 44*b*, one associated with each of hydraulic actuator 28 and hydraulic actuator 30, respectively. Sensor 44*a* may be disposed adjacent to and/or within hydraulic actuator 28 to generate a signal indicative of an extension of hydraulic actuator 28. It is contemplated that the signal generated by sensor 44*a* may represent values proportional to at least one of work tool angle α, frame arm angle β, dig angle θ, and work tool height H. It is also contemplated that sensor 44*a* may embody any type of sensor known in the art, such as, for example, a position sensor. That is, sensor 44*a* may generate a signal indicative of a length distance within a chamber of hydraulic actuator 28. It is contemplated that sensor 44*a* may selectively include a plurality of sensors each establishing a plurality of signals, and that the plurality of signals may be combinable into a common signal.

Sensor 44*b* may operate similarly to sensor 44*a*. More specifically, sensor 44*b* may be disposed adjacent to and/or within hydraulic actuator 30 to generate a signal indicative of an extension of hydraulic actuator 30. It is contemplated that the signal generated by sensor 44*b* may represent values proportional to at least one of work tool angle α, frame arm angle β, dig angle θ, and work tool height H. It is also contemplated that sensor 44*b* may embody any type of sensor known in the art, such as, for example, a position sensor. That is, sensor 44*b* may generate a signal indicative of a length distance within a chamber of hydraulic actuator 30. It is contemplated that sensor 44*b* may selectively include a plurality of sensors each establishing a plurality of signals, and that the plurality of signals may be combinable into a common signal.

Mobile machine 10 may include one or more inertial motion units, or IMUs 45. An IMU is a measuring device that itself may include a number of sensors, and may therefore be considered a "sensor" in the context of the present application. The sensors of the IMU may include accelerometers and/or gyroscopes. The sensors may generate signals indicative of various positional attributes of the object to which the IMU is attached, such as a change in the velocity of the object, a change in the attitude/orientation of the object, and a change in the path of travel of the object. The IMU determines the acceleration of the object based on the signals generated by the sensors of the IMU. For example, mobile machine 10 may include a first IMU 45*a* mounted on frame 22 and a second IMU 45*b* mounted on ripper 18. Optionally, a third IMU 45*c* could be mounted on frame arm 23. GNSS and its satellite positioning unit (e.g., sensor 42) can be used to correct any bias in the output provided by IMUs 45*a*, 45*b*, 45*c* in order to obtain more accurate readings and therefore enable more precise control of mobile machine 10 and ripper 18.

In some instances, an IMU, including IMUs 45*a*, 45*b*, 45*c*, determines changes in rotational attributes, such as, pitch, roll, and yaw, of the object to which it is attached. In the context of mobile machine 10, the pitch describes rotation about an axis running from the left of mobile machine 10 to the right of mobile machine 10, roll describes rotation about an axis running from the front of mobile machine 10 to the rear of mobile machine 10, and yaw describes rotation about an axis that runs vertically through mobile machine 10.

Controller 46 may receive the signals generated by sensors 40, 42, 44 to assist in controlling operation of mobile machine 10. That is, controller 46 may be communicatively coupled with sensors 40, 42, 44, deceleration pedal 32, ripper control 34, hydraulic actuators 28, 30, user interface 39, and any other component of mobile machine 10 that may be used in controlling operation of mobile machine 10.

Controller 46 may embody a single microprocessor or multiple microprocessors that include a means for controlling mobile machine 10. For example, controller 46 may include a memory, a secondary storage device, and a processor, such as a central processing unit or any other means for controlling mobile machine 10. Numerous commercially available microprocessors can be configured to perform the functions of controller 46. It should be appreciated that controller 46 could embody a general power source microprocessor capable of controlling numerous power source functions. Various other known circuits may be associated with controller 46, including power supply circuitry, signal-conditioning circuitry, solenoid driver circuitry, communication circuitry, and other appropriate circuitry. It should also be appreciated that controller 46 may include one or more of an application-specific integrated circuit (ASIC), a field-programmable gate array (FPGA), a computer system, and a logic circuit, configured to allow controller 46 to function. Thus, the memory of controller 46 may embody, for example, the flash memory of an ASIC, flip-flops in an FPGA, the random access memory of a computer system, or a memory circuit contained in a logic circuit. Controller 46 may be further communicatively coupled with an external computer system, instead of or in addition to including a computer system.

Controller 46 may control the movement of ripper 18. To that end, controller 46 may receive input signals from an operator of mobile machine 10, monitor signals generated by sensors 40, 42, 44, perform one or more algorithms to determine appropriate output signals, and deliver the output signals to one or more components of mobile machine 10 to control work tool angle α, frame arm angle β, dig angle θ, and work tool height H. For example, controller 46 may store in its memory a plurality of values representing the possible work tool angle, frame arm angle β, dig angle θ, and work tool height H values, each value being mapped to corresponding configurations and/or operations of shank 26. Controller 46 may cause shank 26 to move to one of those values based on the current configuration and/or operation of shank 26. More specifically, controller 46 may monitor the signals generated by sensors 44*a*, 44*b* for the extension of hydraulic actuators 28, 30, convert those signals to a value of work tool angle α, frame arm angle β, dig angle θ, and/or work tool height H they represent, and compare them to one or more values stored in the memory of controller 46. Controller 46 may then drive hydraulic actuators 28, 30 to move shank 26 until the values indicated by the signal from sensors 44*a*, 44*b* substantially equal the values stored in the memory of controller 46.

Controller 46 may set the depth of cut of shank 26 (i.e., work tool height H) in a similar manner, More specifically, controller 46 may monitor the signal generated by sensor 44*a* for the extension of hydraulic actuator 28, convert it to value representing the possible work tool heights H it represents, and compare it to one or more values stored in the memory of controller 46, driving hydraulic actuator 28 until the two values are substantially equal. Controller 46 may drive hydraulic actuators 28, 30 by controlling one or more valves and/or other components of an associated hydraulic system, e.g., pumps, to selectively supply pressurized fluid to and drain the fluid from hydraulic actuators 28, 30.

Controller 46 may also control the acceleration and deceleration of traction device 16. That is, controller 46 may be communicatively connected to power source 14 to affect the operation of power source 14 by increasing or reducing an amount of fuel delivered to power source 14, changing a timing of fuel injections into power source 14, increasing or reducing an amount of air delivered to power source 14, and/or increasing or reducing an amount of electrical power output by power source 14. It is contemplated that controller 46 may alternatively control the acceleration and deceleration of traction device 16 by directly manipulating the position of deceleration pedal 32, if desired.

FIG. 4A shows mobile machine 10 with its surface-engaging implement 18 in a stowed position $P_S$, while FIG. 4B shows mobile machine 10 with its surface-engaging implement 18 in an operational position $P_O$. In stowed position $P_S$, surface-engaging implement 18 does not contact work surface 12. In operational position $P_O$, surface-engaging implement 18 at least partially contacts work surface 12 (e.g., vis-à-vis work tool 26).

The contact points of mobile machine 10, and particularly its traction device 16, with respect to work surface 12 can change depending on whether surface-engaging implement 18 is in stowed position $P_S$ or operational position $P_O$. Specifically, in stowed position $P_S$, the full extent of the portions of traction device 16 that face work surface 12, namely traction device front portions 16*a* and traction device rear portions 16*b*, are in contact with work surface 12. This can result in the contact patch between mobile machine 10 and work surface 12 (i.e., vis-à-vis traction device 16) having a generally rectangular shape, which is a typical overall shape of traction device 16.

However, when surface-engaging implement 18 is in operational position $P_O$, as shown in FIG. 4B, it is possible that the portions of traction device 16 closest to surface-engaging implement 18, namely traction device rear portions 16*b*, may be lifted off work surface 12, resulting in smaller contact patch between mobile machine 10 and work surface 12 as compared to when surface-engaging implement 18 is in stowed position $P_S$. In certain situations, this can also result in the contact patch having a generally triangular shape, the points of the triangle comprising traction device front portions 16*a* and work tool or shank 26 of surface-engaging implement 18. For example, traction device rear portions 16*b* could be lifted off work surface 12 when surface-engaging implement 18 is in operational position $P_O$ and surface-engaging implement 18 comes into contact with an obstruction O in and/or beneath work surface 12 that is not capable of being moved by mobile machine 10 or is very difficult to move (e.g., a large boulder).

When the contact patch between mobile machine 10 and work surface 12 is reduced (e.g., when surface-engaging implement 18 is in operational position $P_O$ and comes into contact with a significant obstruction O), the likelihood that mobile machine 10 may rollover increases. The likelihood of rollover of mobile machine 10 can also increase if work surface 12 results in mobile machine 10 having a significant roll angle and/or pitch angle with respect to the horizon, irrespective of whether surface-engaging implement 18 is in operational position $P_O$ or stowed position $P_S$ (e.g., if mobile machine 10 is disposed on a hill having a significant incline), the horizon being the line at which the earth and the sky appear to meet. While an operator of mobile machine 10 may adjust mobile machine 10 and/or its surface-engaging implement 18 to reduce the probability of rollover in such situations, the operator must be both skilled and attentive in order to do so.

SUMMARY

One aspect of the present disclosure is directed to a mobile machine for operation on a work surface, the mobile machine comprising: a frame; a traction device mounted to the frame, the traction device being configured to move the mobile machine with respect to the work surface; a surface-engaging implement mounted to the frame, the surface-engaging implement having an implement position movable between an operational position, in which the surface-engaging implement at least partially contacts the work surface, and a stowed position, in which the surface-engaging implement does not contact the work surface; at least one actuator connecting the surface-engaging implement to the frame, the at least one actuator being configured to move the surface-engaging implement between the operational position and the stowed position; a first sensor configured to provide the implement position of the surface-engaging implement; a second sensor configured to provide a machine orientation of the mobile machine with respect to a horizon; and a controller configured to receive the implement position and the machine orientation, and, if the machine orientation exceeds a machine orientation threshold, to at least one of: if the implement position is the operational position, move the surface-engaging implement to the stowed position, stop the mobile machine, or provide an indication to an operator of the mobile machine.

Another aspect of the present disclosure is directed to a method for limiting rollover of a mobile machine with respect to a work surface, the mobile machine having a surface-engaging implement for engaging the work surface, the surface-engaging implement having an implement position movable between an operational position, in which the surface-engaging implement at least partially contacts the work surface, and a stowed position, in which the surface-engaging implement does not contact the work surface, the method comprising: receiving, by a controller of the mobile machine, the implement position of the surface-engaging implement; receiving, by the controller, a machine orientation of the mobile machine with respect to a horizon; evaluating, by the controller, the implement position and the machine orientation, and, if the machine orientation exceeds a machine orientation threshold, at least one of: if the implement position is the operational position, moving the surface-engaging implement to the stowed position, stopping the mobile machine, or providing an indication to an operator of the mobile machine.

A further aspect of the present disclosure is directed to a controller for a mobile machine having a surface-engaging implement for engaging a work surface, the surface-engaging implement having an implement position movable between an operational position, in which the surface-engaging implement at least partially contacts the work surface, and a stowed position, in which the surface-engaging implement does not contact the work surface, the controller being configured to: receive the implement position of the surface-engaging implement; receive a machine orientation of the mobile machine with respect to a horizon; evaluate the implement position and the machine orientation, and, if the machine orientation exceeds a machine orientation threshold, at least one of: if the implement position is the operational position, move the surface-engaging implement to the stowed position, stop the mobile machine, or provide an indication to an operator of the mobile machine.

DETAILED DESCRIPTION

The present application describes systems, methods, and controllers that allow a mobile machine, such as a bulldozer, to automatically limit or reduce the likelihood of rollover of the mobile machine. In particular, if the mobile machine includes a surface-engaging implement, such as a ripper, and the surface-engaging implement is in an operational position, the contact patch between the traction device of the mobile machine and the work surface on which the mobile machine operates may be reduced as compared to when the surface-engaging implement is in a stowed position, increasing the likelihood of rollover. The risk of rollover may also be increased if the work surface on which the mobile machine is operating results in the mobile machine having a significant roll angle and/or pitch angle with respect to the horizon, which itself can further reduce the amount of contact between the traction device and the work surface.

By monitoring one or more variables associated with the mobile machine while it is operating on the work surface, the systems, methods, and controllers of the present application can automatically take evasive action to lower rollover risk. Automating this feature may reduce the need for operator inputs, and make the mobile machine more intuitive to operate, all of which can contribute to safer operation.

Figure 1:
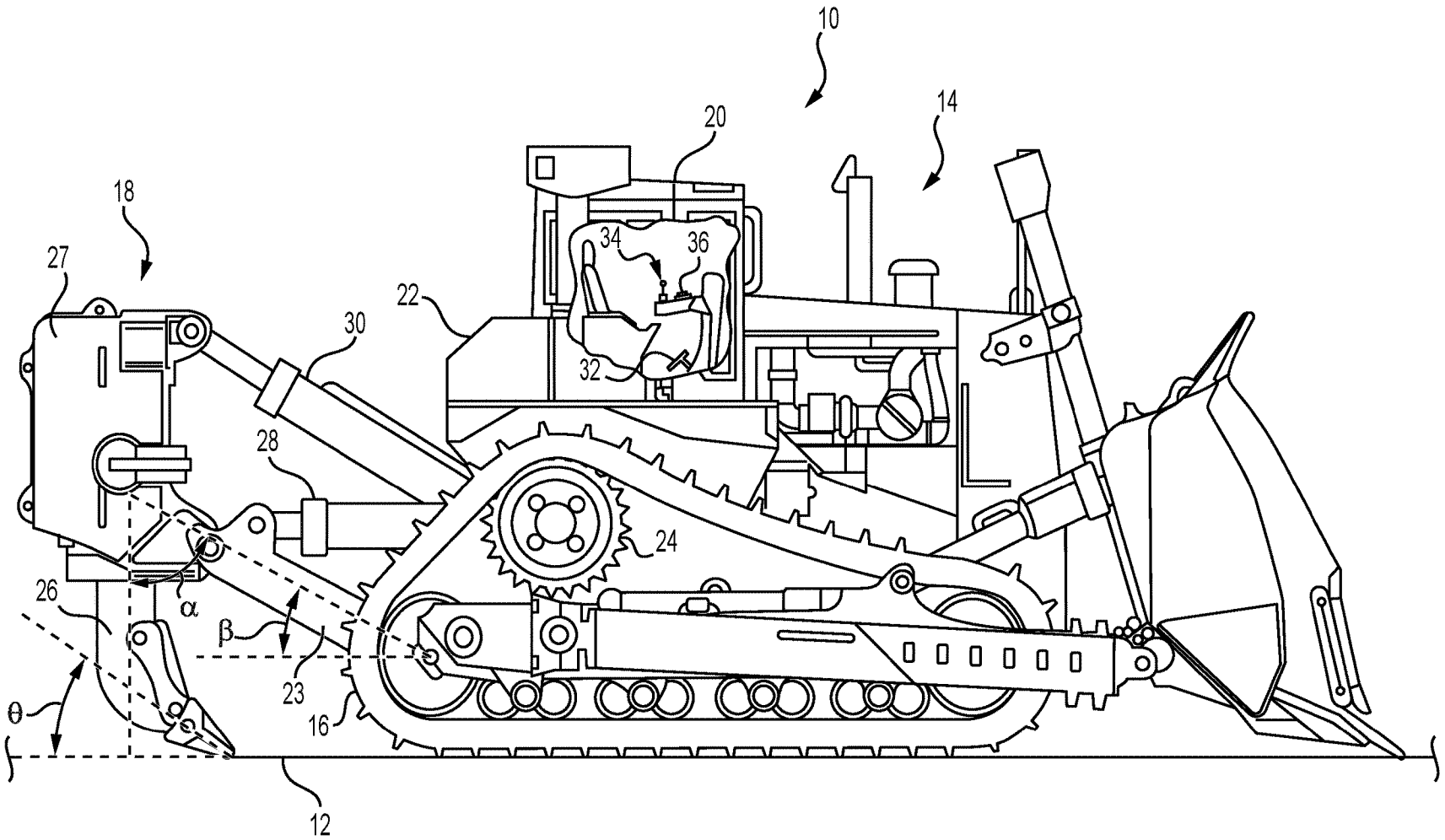
FIG. 1 (PRIOR ART)
FIG. 1 is a side view of a conventional bulldozer, which is an example of a mobile machine.
Figure 2:
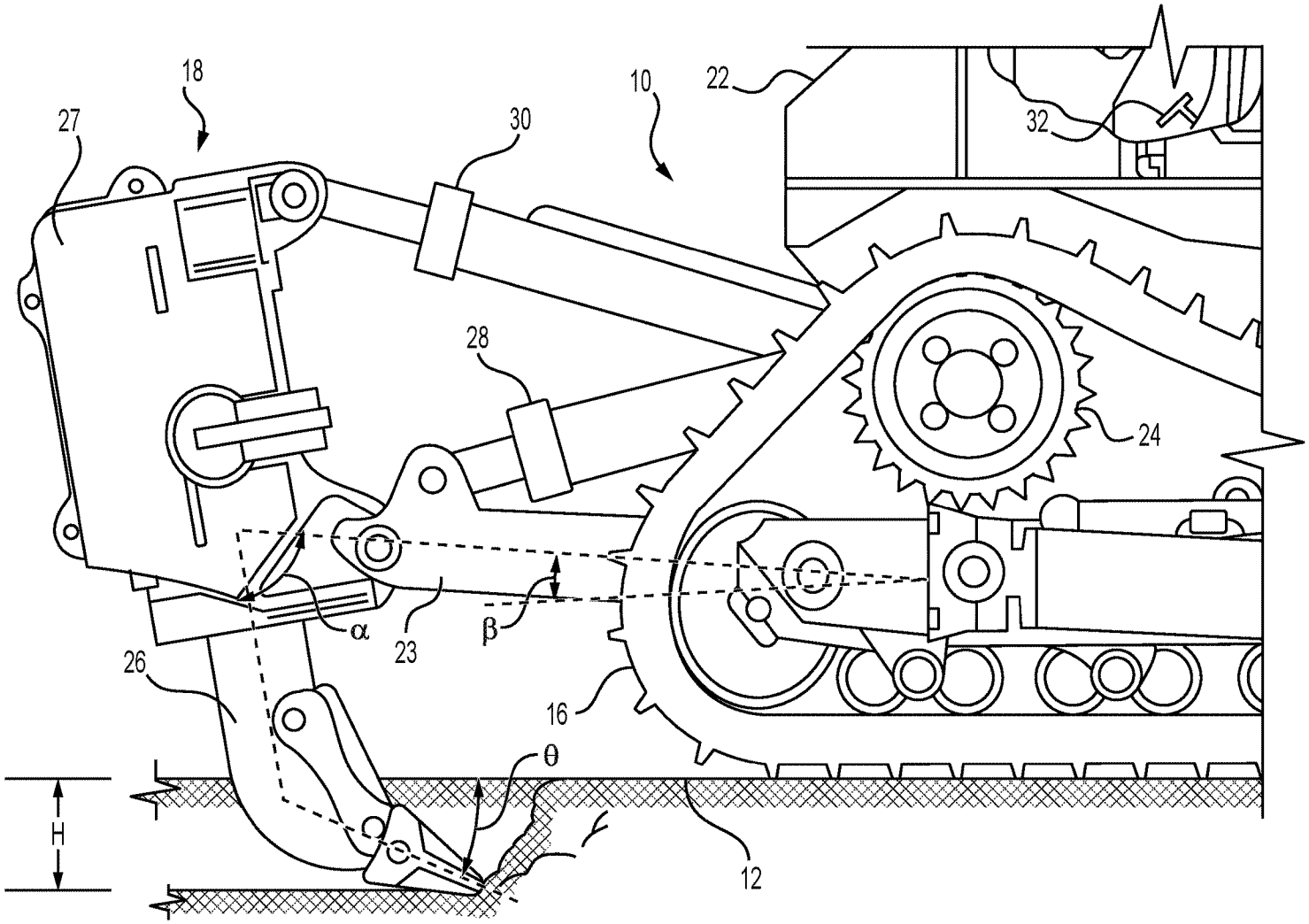
FIG. 2 (PRIOR ART)
FIG. 2 is a detailed view of the bulldozer of FIG. 1 showing a ripper mounted to the bulldozer.
Figure 3:
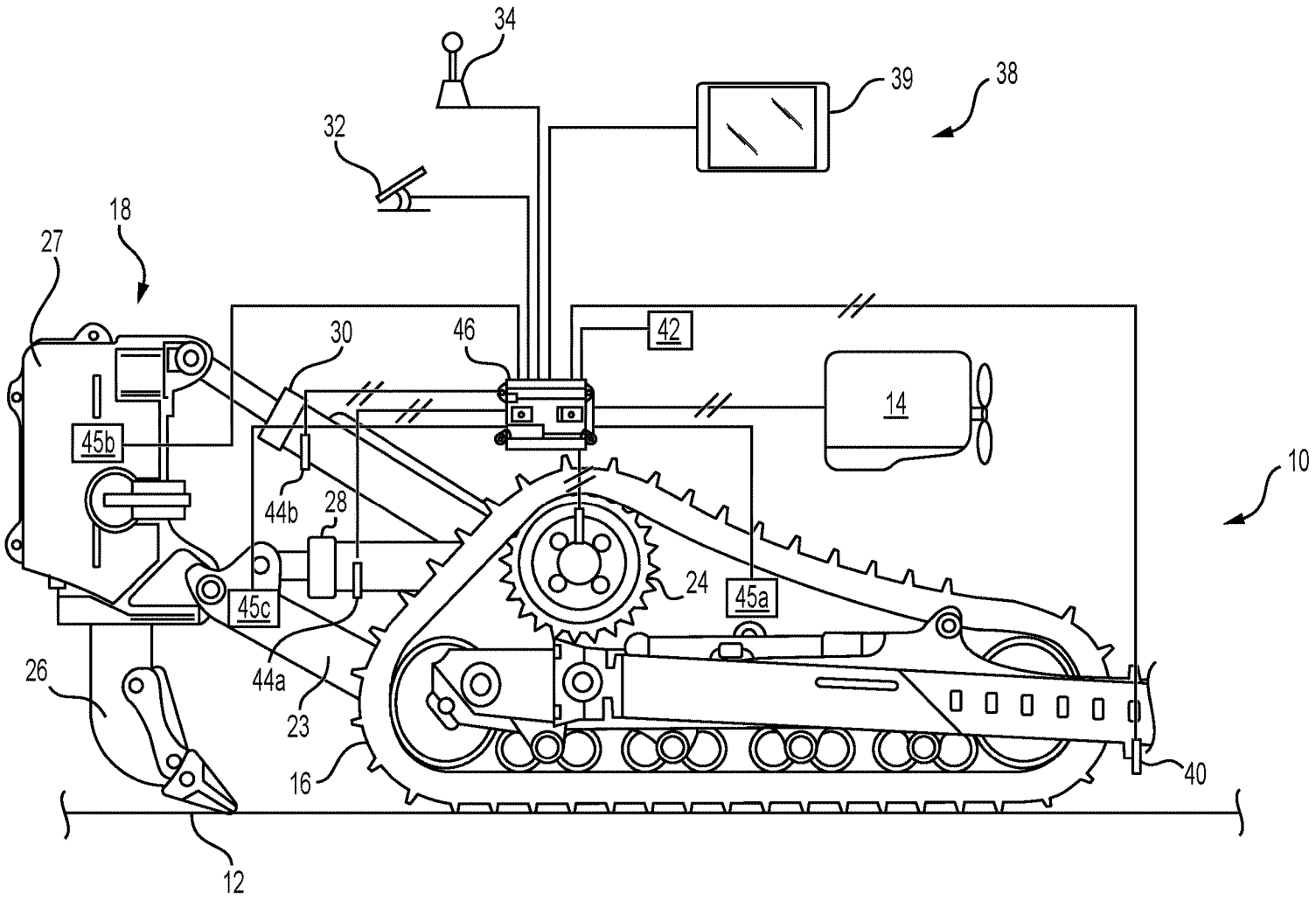
FIG. 3 (PRIOR ART)
FIG. 3 shows various components of a control system of the bulldozer of FIG. 1.
Figure 4A:
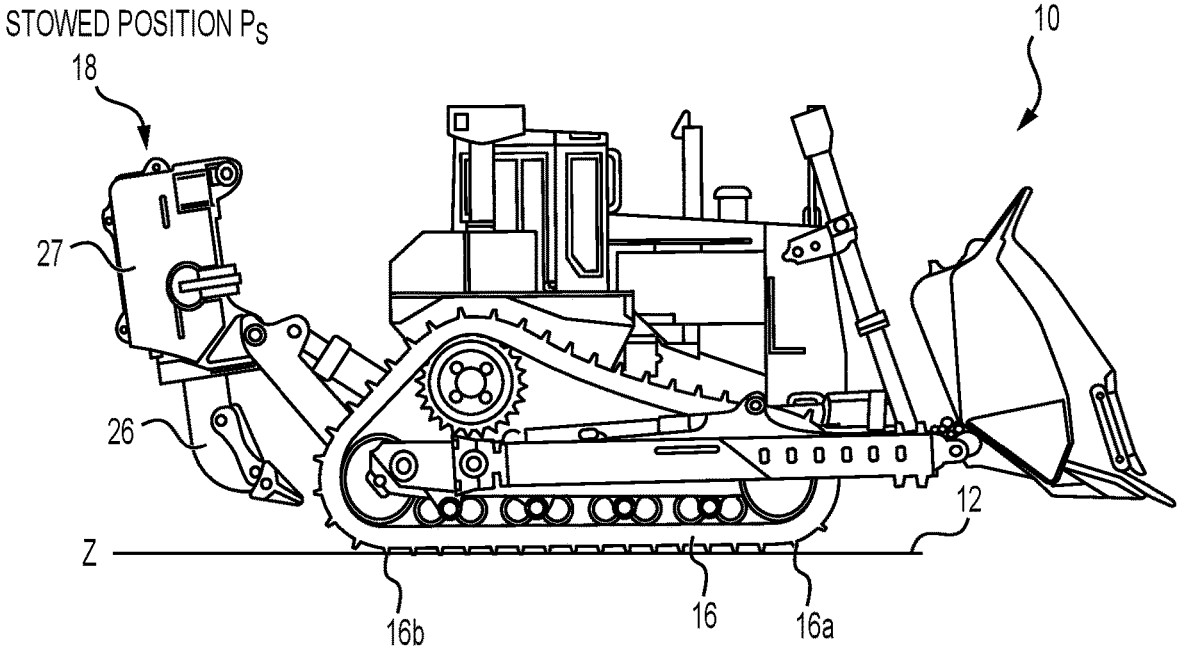
FIG. 4A (PRIOR ART)
FIG. 4A shows the bulldozer of FIG. 1 with its ripper in a stowed position.
Figure 4B:
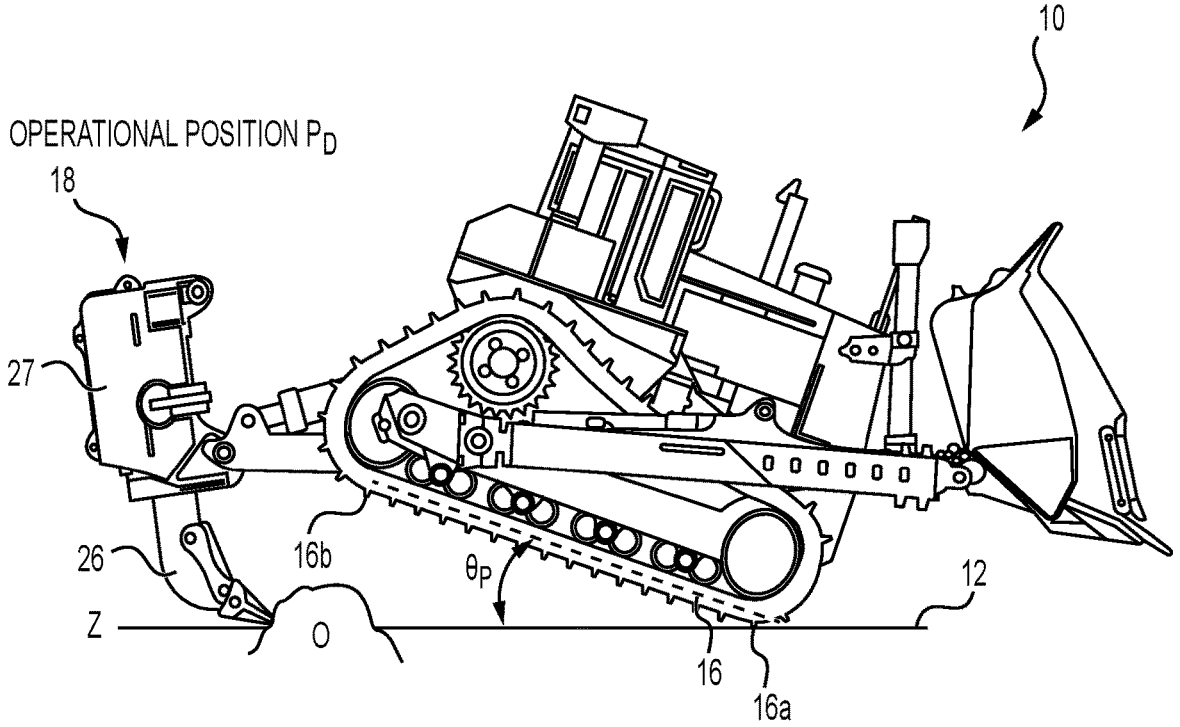
FIG. 4B (PRIOR ART)
FIG. 4B shows the bulldozer of FIG. 1 with its ripper in an operational position.
Figure 5:
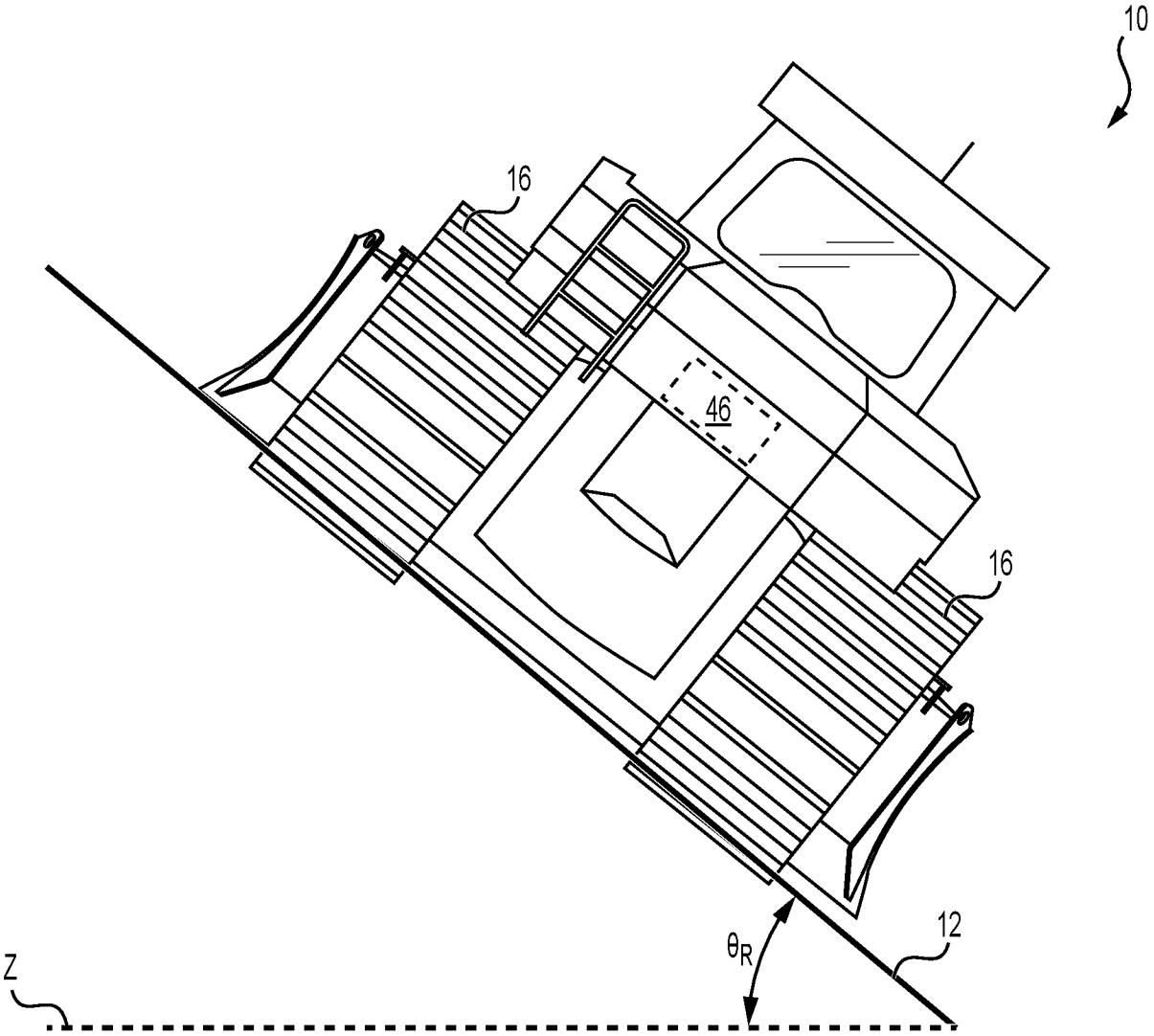
FIG. 5 shows a bulldozer at a roll angle in accordance with the present disclosure.
Figure 6:
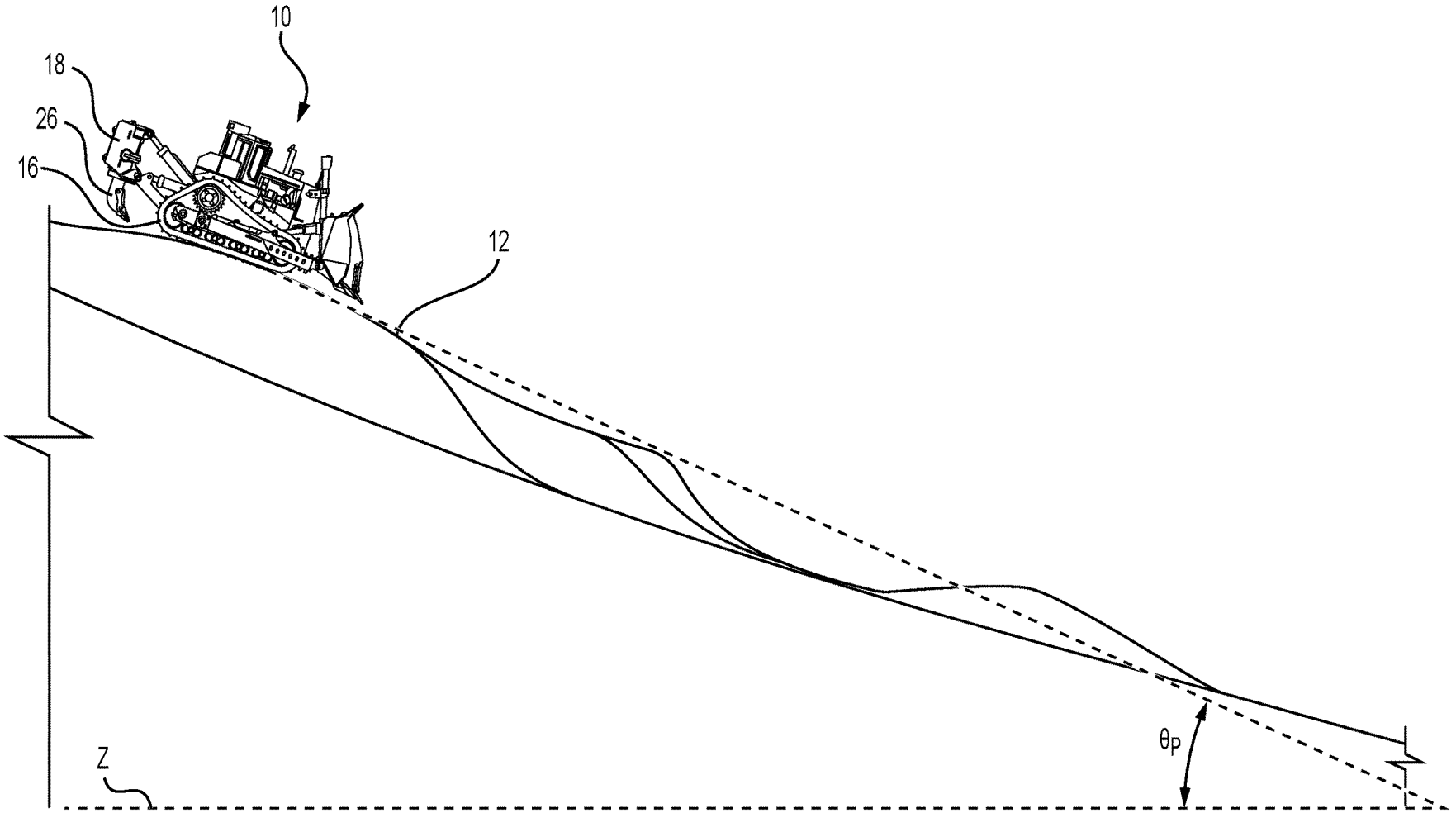
FIG. 6 shows a bulldozer at a pitch angle in accordance with the present disclosure.

FIGS. 5-6 show a mobile machine 10 similar to that described in connection with FIGS. 1-4B, except in the context of FIGS. 5-6 mobile machine 10 is equipped with technology that facilitates the features of the present application. In FIG. 5, which is a view of the rear of mobile machine 10, surface-engaging implement 18 is not shown for clarity.

In the context of the present application, controller 46 of mobile machine 10 is configured to receive implement position $P_{18}$ of surface-engaging implement 18. Implement position $P_{18}$ may be provided by one or more sensors, such as sensors 44, 44*a*, 44*b* associated with hydraulic actuator 28 and hydraulic actuator 30. Specifically, sensors 44*a*, 44*b* associated with hydraulic actuator 28 and hydraulic actuator 30, respectively, could output values corresponding to their extension, which values in turn correspond to a specific implement position $P_{18}$ of either ripper 18 or shank 26 (e.g., operational position $P_O$ or stowed position $P_S$). Outputs of sensors 44*a*, 44*b* could be used to determine implement position $P_{18}$ based on the structural geometry of one or more of frame 22, ripper 18, frame arm 23, hydraulic actuators 28, 30, and shank 26, among other components of mobile machine 10.

Controller 46 is also configured to receive machine orientation $\omega_{10}$. Machine orientation $\omega_{10}$ can comprise roll angle $\theta_R$ of mobile machine 10 with respect to horizon Z, as shown in FIG. 5. Either alternatively or in addition, machine orientation $\omega_{10}$ can comprise pitch angle $\theta_P$ of mobile machine 10 with respect to horizon Z, as shown in FIG. 6. In either case, however, both roll angle $\theta_R$ and pitch angle $\theta_P$ are a useful indication of machine orientation $\omega_{10}$.

Roll angle $\theta_R$ and pitch angle $\theta_P$ can be provided by, for example, one or more inertial motion units (IMUs) 45. In an embodiment, roll angle $\theta_R$ and/or pitch angle $\theta_P$ could be provided by first IMU 45*a* mounted on frame 22. By taking readings from first IMU 45*a* rather than from another IMU attached to a different part of mobile machine 10 (e.g., second IMU 45*b* mounted on ripper 18 and/or third IMU 45*c* could be mounted on frame arm 23), the systems, methods, and controllers of the present application obtain a better indication of whether mobile machine 10 is likely to rollover, as frame 22 represents the bulk of the mass of mobile machine 10, and is therefore closely associated with center of gravity of mobile machine 10. Nevertheless, inputs from other IMUs, such as second IMU 45*b* or third IMU 45*c*, could be used to provide an indication of roll angle $\theta_R$ and/or pitch angle $\theta_P$ and therefore machine orientation $\omega_{10}$, either alone or in conjunction with outputs from first IMU 45*a*.

Upon receiving implement position $P_{18}$ and machine orientation $\omega_{10}$, controller 46 then determines whether machine orientation $\omega_{10}$ exceeds a machine orientation threshold $T_\omega$. Machine orientation threshold $T_\omega$ matches the dimension and units of machine orientation $\omega_{10}$, and therefore roll angle $\theta_R$ and/or pitch angle $\theta_P$. For example, if roll angle $\theta_R$ and/or pitch angle $\theta_P$ is a scalar quantity, then machine orientation threshold $T_\omega$ is also a scalar quantity. If more granularity is desired in the systems, methods, and controllers of the present application, machine orientation $\omega_{10}$ could be a multi-dimensional vector, which would also result in machine orientation threshold $T_\omega$ also being a multi-dimensional vector. Likewise, if the units of machine orientation $\omega_{10}$ are, for example, degrees, then the units of machine orientation threshold $T_\omega$ would also be degrees. As one example, machine orientation threshold $T_\omega$ could be 30°, which is the approximate roll angle $\theta_R$ shown in FIG. 5.

If machine orientation $\omega_{10}$ comprises roll angle $\theta_R$ of mobile machine 10 with respect to horizon Z, then machine orientation threshold $T_\omega$ can comprise a roll angle threshold $T_{\theta R}$. Similarly, if machine orientation $\omega_{10}$ comprises pitch angle $\theta_P$ of mobile machine 10 with respect to horizon Z, then machine orientation threshold $T_\omega$ can comprise a pitch angle threshold $T_{\theta P}$. In this manner, controller 46 can base its determination of whether mobile machine 10 is at risk for a rollover event on the pitch or roll, respectively, of mobile machine 10. Roll angle threshold $T_{\theta R}$ and pitch angle threshold $T_{\theta P}$ could be the same or different values (e.g., 30°). Allowing roll angle threshold $T_{\theta R}$ and pitch angle threshold $T_{\theta P}$ to be different values can account for different polar moments of inertia of mobile machine 10 in different directions. For example, a rollover event may be more likely for mobile machine 10 in response to rolling rather than pitching due to the fact that mobile machine 10 is likely longer than it is wider. As such, roll angle threshold $T_{\theta R}$ could be set to a lower value (e.g., 20°) than pitch angle threshold $T_{\theta P}$ (e.g., 30°) in order to account for this difference in geometry.

If controller 46 determines that machine orientation $\omega_{10}$ exceeds such a machine orientation threshold $T_\omega$, controller 46 then knows that mobile machine 10 is in danger of rolling over. Controller 46 can then be programmed to take evasive action so as to avoid rollover, or at least reduce the likelihood of rollover.

For example, if controller 46 determines that machine orientation $\omega_{10}$ exceeds such machine orientation threshold $T_\omega$, controller 46 could issue commands to mobile machine 10 to move surface-engaging implement 18 to stowed position $P_S$ if surface-engaging implement 18 is in operational position $P_O$. Controller 46 can determine whether surface-engaging implement 18 is in operational position $P_O$ by evaluating implement position $P_{18}$. By instructing surface-engaging implement 18 to move to stowed position $P_S$ when surface-engaging implement 18 is in operational position $P_O$, traction device rear portions 16*b* could, for example, be lowered from the position shown in FIG. 4B (i.e., up in the air and above work surface 12) to the position shown in FIG. 4A (i.e., in contact with work surface 12). By moving surface-engaging implement 18 to stowed position $P_S$, the area of the contact patch between traction device 16 and work surface 12 increases, and the risk of rollover of mobile machine 10 correspondingly decreases. Controller 46 can cause surface-engaging implement 18 to move to stowed position $P_S$ by actuating one or both of first hydraulic actuator 28 to lift and lower surface-engaging implement 18 and second hydraulic actuator 30 to tilt surface-engaging implement 18. Either one of lifting or tilting surface-engaging implement 18 can result in moving surface-engaging implement 18 to stowed position $P_S$.

Either alternatively or in addition, when machine orientation $\omega_{10}$ exceeds such machine orientation threshold $T_\omega$, controller 46 could issue commands to stop mobile machine 10. Controller 46 can affect the speed of mobile machine 10, including bringing mobile machine 10 to a stop, in the typical sense, namely by controlling one or more of power source 14, traction device 16, deceleration pedal 32, applying friction-driven braking force, etc. By stopping mobile machine 10, controller 46 can at least effectively pause the movement of mobile machine 10 so as to potentially ensure the risk of rollover of mobile machine 10 does not increase. Once mobile machine 10 is stopped, the operator of mobile machine 10 can then take appropriate action (e.g., raise and/or retract surface-engaging implement 18) to lower the risk of rollover.

Either alternatively or in addition, when machine orientation $\omega_{10}$ exceeds such machine orientation threshold $T_\omega$, controller 46 could provide an indication I to an operator of mobile machine 10. In response to indication I, the operator could then determine what sort of action is necessary to lower the risk of rollover (e.g., e.g., raise and/or retract surface-engaging implement 18 and/or stop mobile machine 10). This particular feature helps to combat potential inattentiveness of the operator to the operations of mobile machine 10, or serve as a warning to an operator who may be less experienced in operating mobile machine 10 and less aware of its limits. Indication I can comprise at least one of an audio alert, a visual alert, or a haptic alert, for example.

To the extent machine orientation $\omega_{10}$ subsequently falls below machine orientation threshold $T_\omega$, controller 46 can determine that the risk of a rollover event for mobile machine 10 is within an acceptable range, such that it is possible to resume normal operation of mobile machine 10 and its surface-engaging implement 18 on work surface 12. In this situation, controller 46 can issue one or more commands (e.g., to first hydraulic actuator 28 and/or second hydraulic actuator 30) to move surface-engaging implement 18 from stowed position $P_S$ to operational position $P_O$.

In one embodiment, machine orientation $\omega_{10}$ falls below machine orientation threshold $T_\omega$ if roll angle $\theta_R$ of mobile machine 10 with respect to horizon Z falls below roll angle threshold $T_{\theta R}$. In another embodiment, machine orientation $\omega_{10}$ falls below machine orientation threshold $T_\omega$ if pitch angle $\theta_P$ of mobile machine 10 with respect to horizon Z falls below pitch angle threshold $T_{\theta P}$. In either case, however, controller 46 can determine that the likelihood of rollover risk is reduced enough so as to not present a serious safety risk, such that normal operation of mobile machine 10 and/or its surface-engaging implement 18 on work surface 12 can resume.

Figure 7:
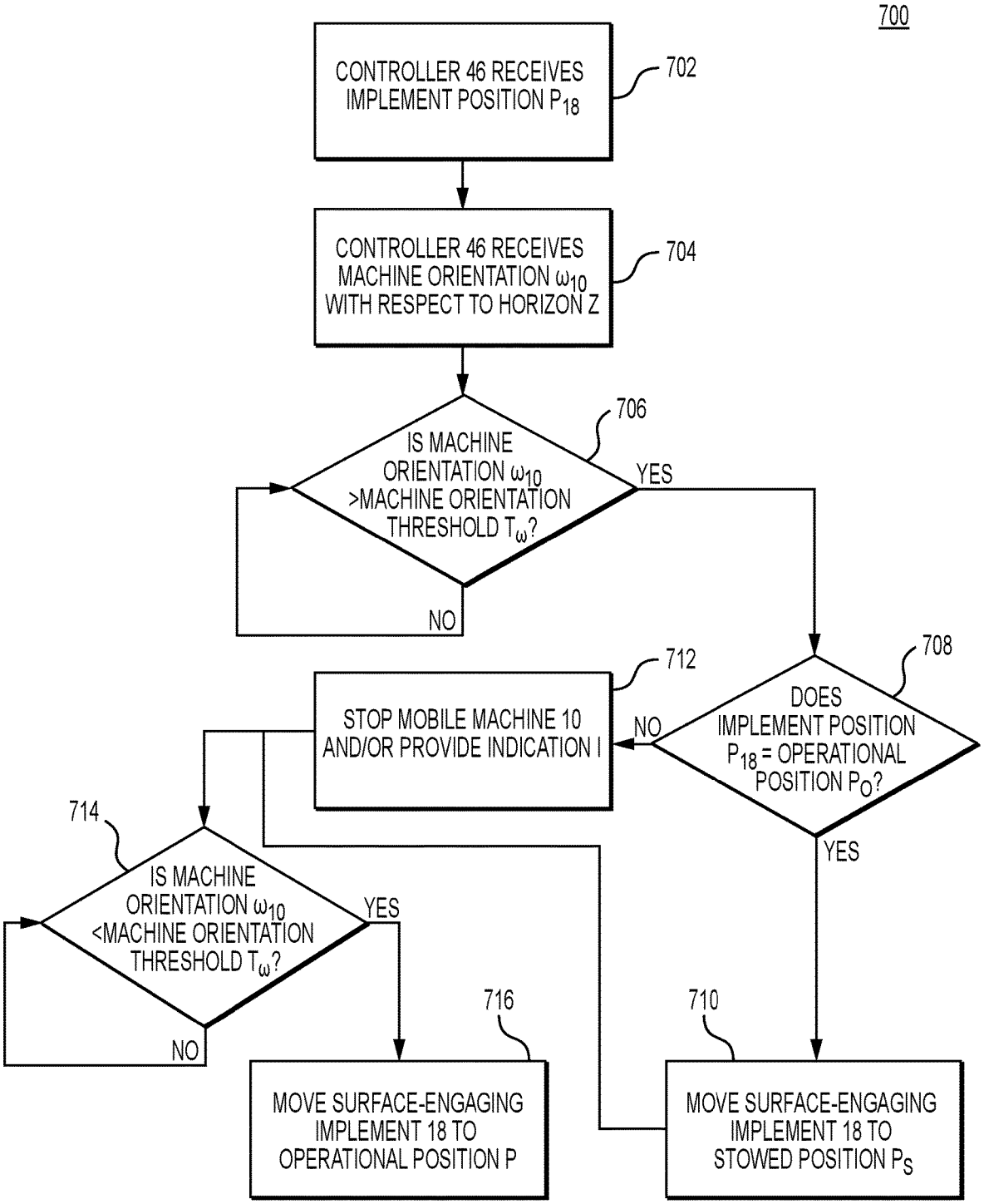
FIG. 7 shows a flowchart of a method for operating a mobile machine according to the present disclosure.

The foregoing discussion is also equally applicable to a method 700 for operating mobile machine 10 at a work site having work surface 12, as demonstrated in connection with FIG. 7. In step 702 of method 700, controller 46 receives implement position $P_{18}$ of surface-engaging implement 18. For example, implement position $P_{18}$ could be stowed position $P_S$ or operational position $P_O$.

In step 704 of method 700, controller 46 receives machine orientation $\omega_{10}$ with respect to horizon Z. As discussed above, machine orientation $\omega_{10}$ could be one or more of roll angle $\theta_R$ or pitch angle $\theta_P$.

In step 706 of method 700, controller 46 evaluates implement position $P_{18}$ and machine orientation $\omega_{10}$. In particular, controller 46 determines whether machine orientation $\omega_{10}$ exceeds machine orientation threshold $T_\omega$. If machine orientation $\omega_{10}$ does not exceed machine orientation threshold $T_\omega$, method 700 continues comparing machine orientation $\omega_{10}$ and machine orientation threshold $T_\omega$.

If, however, machine orientation $\omega_{10}$ exceeds machine orientation threshold $T_\omega$, method 700 proceeds to step 708. In step 708, controller 46 determines whether implement position $P_{18}$ is operational position $P_O$. If implement position $P_{18}$ is operational position $P_O$, controller 46 knows that surface-engaging implement 18 and/or its work tool or shank 26 is in contact with work surface 12 and/or obstruction O. As a result, it is possible that surface-engaging implement 18 is decreasing the area of the contact patch between traction device 16 of mobile machine 10 and work surface 12, increasing the risk of a rollover event. Method 700 then proceeds to step 710, in which controller 46 issues one or more commands to move surface-engaging implement 18 to stowed position $P_S$ (e.g., by actuating at least one of first hydraulic actuator 28 or second hydraulic actuator 30).

If machine orientation $\omega_{10}$ does not exceed machine orientation threshold $T_\omega$, however, method 700 proceeds to step 712. In step 712, controller 46 issues one or more commands to at least one of stop mobile machine 10 or provide indication I to an operator of mobile machine 10. As discussed above, controller 46 can affect the speed of mobile machine 10, including bringing mobile machine 10 to a stop in the typical sense, namely by controlling one or more of power source 14, traction device 16, deceleration pedal 32, applying friction-driven braking force, etc. Furthermore, indication I can comprise at least one of an audio alert, a visual alert, or a haptic alert, for example.

No matter whether method 700 proceeds to step 710 or step 712, in an embodiment method 700 then proceeds to step 714, where controller 46 evaluates whether machine orientation $\omega_{10}$ falls below machine orientation threshold $T_\omega$. If machine orientation $\omega_{10}$ falls below machine orientation threshold $T_\omega$, controller 46 knows the risk of rollover of mobile machine 10 has returned to a low enough level that it is safe to resume normal operation of mobile machine 10 and/or surface-engaging implement 18 on work surface 12. Method 700 then proceeds to step 716, where controller 46 issues one or more commands to cause surface-engaging implement 18 to return to operational position $P_O$ (e.g., by actuating at least one of first hydraulic actuator 28 or second hydraulic actuator 30).

If machine orientation $\omega_{10}$ does not fall below machine orientation threshold $T_{\omega}$, method 700 continues comparing machine orientation $\omega_{10}$ and machine orientation threshold $T_{\omega}$.

Other variations of method 700 are also contemplated and within the scope of the present disclosure.

INDUSTRIAL APPLICABILITY

In general, the systems, methods, and controllers of the present application are applicable for reducing or limiting the risk of rollover of a mobile machine. If a surface-engaging implement mounted to the mobile machine increases the likelihood of a rollover event, the systems, methods, and controllers of the present application are capable of automatically adjusting the surface-engaging implement (e.g., by moving it to a stowed position) so as to increase the area of a contact patch between the traction device of the mobile machine and the work surface on which the mobile machine is operating. Alternatively, a controller of the mobile machine can stop the mobile machine or provide an indication to an operator of the mobile machine that there is an increased risk of rollover. These actions can help to lower the rollover risk back to an acceptable level.

If the nature of the work surface itself results in a machine orientation of the mobile machine exceeding a threshold corresponding to a higher rollover risk, the systems, methods, and controllers of the present application are also capable of automatically recognizing that situation (e.g., through the use of one or more sensors, such as an IMU) and responding accordingly in a similar fashion.

In sum, all of these features combine to provide for safer and more effective operation of the mobile machine on the work surface.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The present disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context,

What is claimed is:

1. A mobile machine for operation on a work surface, the mobile machine comprising:

a frame;

a traction device mounted to the frame, the traction device being configured to move the mobile machine with respect to the work surface;

a surface-engaging implement mounted to the frame, the surface-engaging implement being a ripper or scarifier and having an implement position movable between an operational position, in which the surface-engaging implement at least partially contacts the work surface, and a stowed position, in which the surface-engaging implement does not contact the work surface;

at least one actuator connecting the surface-engaging implement to the frame, the at least one actuator being configured to move the surface-engaging implement between the operational position and the stowed position;

a first sensor configured to provide the implement position of the surface-engaging implement;

a second sensor configured to provide a machine orientation of the mobile machine with respect to a horizon; and a controller configured to receive the implement position and the machine orientation, and, if the machine orientation exceeds a machine orientation threshold, to:

if the implement position is the operational position, move the surface-engaging implement to the stowed position, and if the implement position is the stowed position, at least one of:

stop the mobile machine, or provide an indication to an operator of the mobile machine.

2. The mobile machine of claim 1, wherein the machine orientation comprises a roll angle of the mobile machine with respect to the horizon, and the machine orientation threshold comprises a roll angle threshold.

3. The mobile machine of claim 1, wherein the machine orientation comprises a pitch angle of the mobile machine with respect to the horizon, and the machine orientation threshold comprises a pitch angle threshold.

4. The mobile machine of claim 1, wherein the second sensor comprises at least one inertial motion unit (IMU) mounted to the frame, the at least one inertial motion unit being configured to provide at least one of:

a roll angle of the mobile machine with respect to the horizon, or a pitch angle of the mobile machine with respect to the horizon.

5. The mobile machine of claim 1, wherein the at least one actuator comprises a first hydraulic actuator configured to lift and lower the surface-engaging implement, and a second hydraulic actuator configured to tilt the surface-engaging implement.

6. The mobile machine of claim 5, wherein moving the surface-engaging implement to the stowed position comprises at least one of:

lifting the surface-engaging implement, or tilting the surface-engaging implement.

7. The mobile machine of claim 1, wherein the indication comprises at least one of:

an audio alert,
a visual alert, or
a haptic alert.

8. The mobile machine of claim 1, wherein, if the machine orientation falls below the machine orientation threshold, the controller is configured to move the surface-engaging implement from the stowed position to the operational position.

9. The mobile machine of claim 8, wherein the machine orientation falls below the machine orientation threshold if a roll angle of the mobile machine with respect to the horizon falls below a roll angle threshold.

10. The mobile machine of claim 8, wherein the machine orientation falls below the machine orientation threshold if a pitch angle of the mobile machine with respect to the horizon falls below a pitch angle threshold.

11. A method for limiting rollover of a mobile machine with respect to a work surface, the mobile machine having a surface-engaging implement for engaging the work surface, the surface-engaging implement being a ripper or scarifier and having an implement position movable between an operational position, in which the surface-engaging implement at least partially contacts the work surface, and a stowed position, in which the surface-engaging implement does not contact the work surface, the method comprising:
- receiving, by a controller of the mobile machine, the implement position of the surface-engaging implement;
- receiving, by the controller, a machine orientation of the mobile machine with respect to a horizon;
- evaluating, by the controller, the implement position and the machine orientation, and, if the machine orientation exceeds a machine orientation threshold:
  - if the implement position is the operational position, moving the surface-engaging implement to the stowed position, and
  - if the implement position is the stowed position, at least one of:
    - stopping the mobile machine, or
    - providing an indication to an operator of the mobile machine.

12. The method of claim 11, wherein the machine orientation comprises a roll angle of the mobile machine with respect to the horizon, and the machine orientation threshold comprises a roll angle threshold.

13. The method of claim 11, wherein the machine orientation comprises a pitch angle of the mobile machine with respect to the horizon, and the machine orientation threshold comprises a pitch angle threshold.

14. The method of claim 11, wherein the machine orientation comprises at least one of:
- a roll angle of the mobile machine with respect to the horizon, or
- a pitch angle of the mobile machine with respect to the horizon, and
- wherein the roll angle and the pitch angle are provided by at least one inertial motion unit (IMU) mounted to a frame of the mobile machine.

15. The method of claim 11, wherein moving the surface-engaging implement to the stowed position comprises actuating at least one of:
- a first hydraulic actuator configured to lift the surface-engaging implement, or
- a second hydraulic actuator configured to tilt the surface-engaging implement.

16. The method of claim 11, wherein the indication comprises at least one of:
an audio alert,
a visual alert, or
a haptic alert.

17. The method of claim 11, wherein, if the machine orientation falls below the machine orientation threshold, the method further comprises:
- moving the surface-engaging implement from the stowed position to the operational position.

18. A controller for a mobile machine having a surface-engaging implement for engaging a work surface, the surface-engaging implement being a ripper or scarifier and having an implement position movable between an operational position, in which the surface-engaging implement at least partially contacts the work surface, and a stowed position, in which the surface-engaging implement does not contact the work surface, the controller being configured to:
- receive the implement position of the surface-engaging implement;
- receive a machine orientation of the mobile machine with respect to a horizon;
- evaluate the implement position and the machine orientation, and, if the machine orientation exceeds a machine orientation threshold:
  - if the implement position is the operational position, move the surface-engaging implement to the stowed position, and
  - if the implement position is the stowed position, at least one of:
    - stop the mobile machine, or
    - provide an indication to an operator of the mobile machine.

19. The controller of claim 18, wherein moving the surface-engaging implement to the stowed position comprises at least one of:
- actuating a first hydraulic actuator configured to lift the surface-engaging implement, or
- actuating a second hydraulic actuator configured to tilt the surface-engaging implement.

20. The controller of claim 18, wherein the machine orientation comprises at least one of:
- a roll angle of the mobile machine with respect to the horizon, or
- a pitch angle of the mobile machine with respect to the horizon, and
- wherein the roll angle and the pitch angle are provided by at least one inertial motion unit (IMU) mounted to a frame of the mobile machine.

* * * * *